United States Patent [19]

Grulich et al.

[11] 4,086,144

[45] Apr. 25, 1978

[54] PROCESS AND APPARATUS FOR THE SEPARATION OF FLOAT TARS IN THE TAR SEPARATOR OF A COKING INSTALLATION

[75] Inventors: Heinz Grulich, Gladbeck; Ernst Otte, Essen, both of Germany

[73] Assignee: Bergwerksverband GmbH, Essen, Germany

[21] Appl. No.: 746,326

[22] Filed: Dec. 1, 1976

Related U.S. Application Data

[63] Continuation-in-part of Ser. No. 632,360, Nov. 17, 1975, abandoned.

[30] Foreign Application Priority Data

Nov. 16, 1974 Germany ..... 2454394

[51] Int. Cl.[2] ..... C10B 45/00; C10B 57/00

[52] U.S. Cl. ..... 201/41; 201/28; 201/27; 201/45; 202/262; 202/270; 210/152

[58] Field of Search ..... 210/21, 152; 201/3, 201/4, 7, 28, 30, 45, 17, 41; 202/260, 261, 263, 254, 270; 208/11 R, 11 LE

[56] References Cited

U.S. PATENT DOCUMENTS

| | | | |
|---|---|---|---|
| 2,246,224 | 6/1941 | Streander | 210/152 |
| 2,395,901 | 3/1946 | Murphree et al. | 210/152 X |
| 2,825,678 | 3/1958 | Jahnig et al. | 210/21 X |
| 2,903,407 | 9/1959 | Fischer et al. | 208/11 LE |
| 3,414,480 | 12/1968 | Stotler et al. | 201/30 X |
| 3,607,720 | 9/1971 | Paulson | 208/11 LE |
| 3,661,719 | 5/1972 | Kelmar | 201/30 X |
| 3,767,536 | 10/1973 | Ikeda et al. | 202/263 |
| 3,841,992 | 10/1974 | Jones, Jr. et al. | 208/11 |
| 3,864,251 | 2/1975 | Cymbalisty | 208/11 LE |

*Primary Examiner*—Morris O. Wolk
*Assistant Examiner*—Michael S. Mercer
*Attorney, Agent, or Firm*—Michael J. Striker

[57] ABSTRACT

The so-called float tar which floats on the stream of crude tar and ammonia water in the tar separator of a coking installation and which interferes with the clean separation of crude tar and ammonia water is removed by skimming the float tar off the crude tar and ammonia water mixture and subjecting the separated float tar to comminution and homogenization whereupon the homogenized tar product may be processed either separately or together with the bulk of the tar. An installation for use in the process comprises a tar separator in the form of an open top separator vessel, a channelled structure associated with the separator vessel, means provided in the separator vessel for skimming the float tar off the bulk of the crude tar and ammonia water and passing it into the channel of said structure, and a comminuting and homogenizing device which communicates with said channel through a grade drop.

6 Claims, 5 Drawing Figures

PROCESS AND APPARATUS FOR THE SEPARATION OF FLOAT TARS IN THE TAR SEPARATOR OF A COKING INSTALLATION

RELATED APPLICATIONS

This application is a continuation-in-part of application Ser. No. 632,360 filed by the same inventor for "Process and Apparatus for the Separation of so-called Float Tars" filed Nov. 17, 1975, now abandoned.

BACKGROUND OF THE INVENTION

In the production of coke in coke ovens from coal substantial amounts of crude gas including ammonia are expelled and are collected in a main collector chamber where the gas is cooled by injection of ammonia water. The ammonia water after rinsing the entire collector chamber then passes, together with substantial amounts of tar separated from the crude gas, into a so-called tar separator. The separation in the tar separator of the tar from the ammonia water is easily accomplished since the tar, because of its higher density forms a lower layer while the ammonia water constitutes the upper layer. The tar and ammonia water are discharged by separate discharge ducts. The ammonia water usually is recycled into the collector chamber while the tar is passed on for further processing.

In recent times preheated coal has been used increasingly as the starting product for producing coke. Unfortunately the preheated coal results in still larger amounts of gases which enclose relatively large amounts of coal dust. As a result there forms in the tar separator a top layer of so-called float tar which principally consists of tar, air bubbles, coal dust and water. This coal tar has a relatively low density and therefore floats on top of the ammonia water. It is principally the coal dust which is responsible for the formation of the frothy float tar.

This rather recent phenomenon has proved to be practically intractible. The float tar cannot simply be united with the bulk of the tar discharged from the lower portion of the tar separator nor can it at reasonable cost be processed separately.

The present invention therefore has the object of providing for a process and apparatus for dealing with this problem, that is, for separating the float tar and converting it in a manner that it can then be processed either separately or together with the bulk of the curde tar discharged from the lower portion of the tar separator.

SUMMARY OF THE INVENTION

This object is accomplished by skimming the float tar off the mixture of crude tar and water flowing through the tar separator vessel and subjecting the separated flotation tar to comminution and homogenization, whereupon the homogenized product may then be processed either separately or together with the bulk of the tar.

Another feature of the invention is an apparatus for use in this process which comprises a tar separator vessel, a channelled structure associated with said separator vessel, means for separating the float tar from the ammonia water mixture in the tar separator vessel and for passing the separated float tar into the channel of said structure and comminuting and homogenizing means which are in communication with said channel whereby a tar is formed in the homogenizing device which may be processed separately or with the bulk of the crude tar.

DISCUSSION OF THE INVENTION AND DESCRIPTION OF A PREFERRED EMBODIMENT

Figure 3:
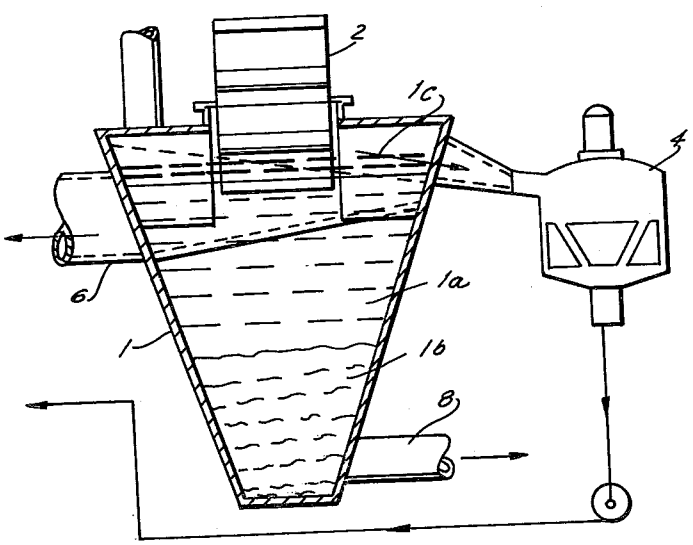
FIG. 3 is a cross-section through lines A—A of the separator of FIG. 1 illustrating also the comminuting device.
Figure 1:
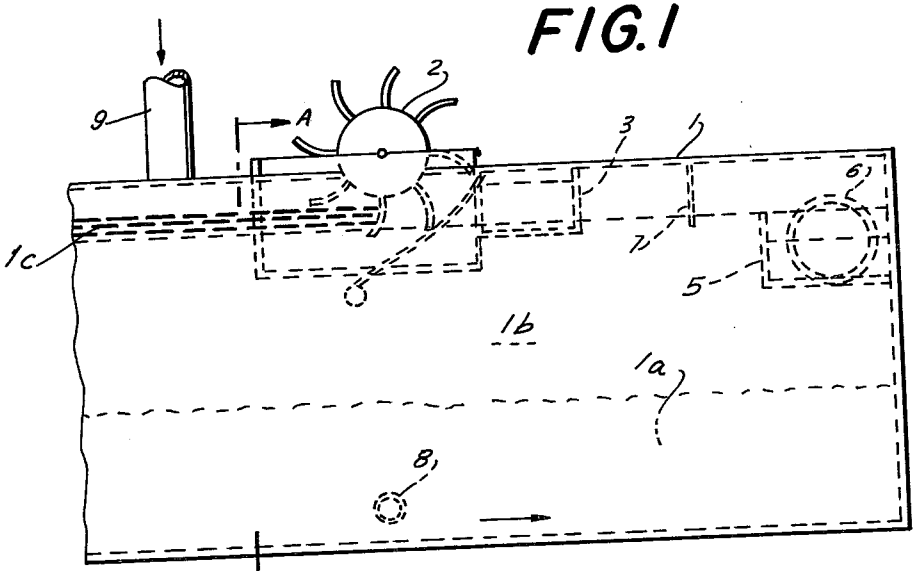
FIG. 1 is a schematic side view of a tar separator with the device of the invention.
Figure 2:
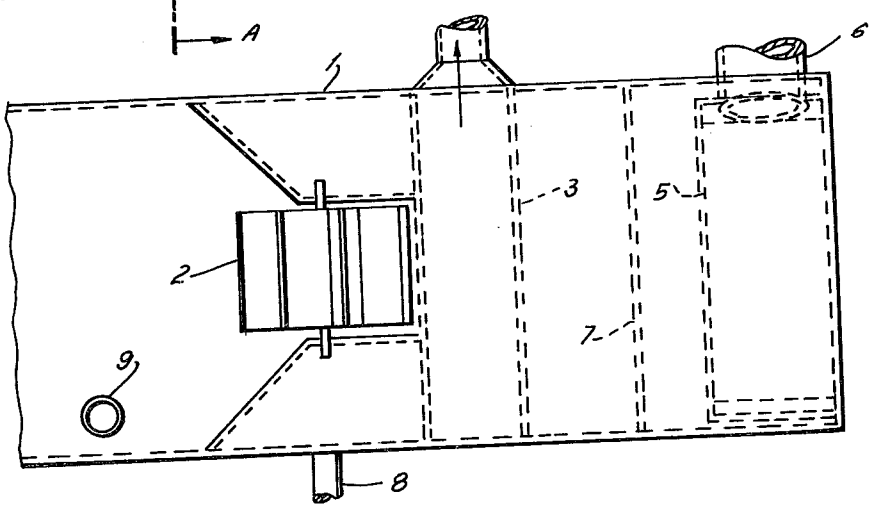
FIG. 2 is a plan view of the device of FIG. 1.

With reference to the drawings it will be seen that through an inlet pipe 9 a mixture of ammonia water and crude tar are passed into a tar separator 1 where the crude tar, because of its higher density forms the lower layer **1*b* while the ammonia water forms the upper layer 1*a*. On top of the ammonia water the previously explained layer of float tar indicated by 1*c* is formed which due to its low density escapes the drain action of the tar outlet 8 which the ammonia water is discharged for recycling through the outlet tube 6**.

A bucket wheel 2 rotates on an axis transversal to the flow in the tar separator. It is in communication with a channel 2 which is formed in a structural floatingly supported on the ammonia water layer in the tank separator. The channel 3 is inclined to pass the flow tar skimmed off the ammonia water-crude tar mixture by the bucket wheel into a comminuting and homogenizing device 4.

Prior to its discharge through outlet tube 6 the ammonia water passes a dam 5. An additional dam 7 is provided to hold back any float tar that may have escaped the bucket wheel or other separator device.

It will be understood that in place of the bucket wheel a further suitable dam may also be employed over which the float tar will flow. Other similar conveyor means by which the float tar may be skimmed off the mass of the ammonia water-crude tar mixture, such as a ribbon scraper, may be used instead of the bucket wheel.

The operation of the device is as follows: The float tar **1*c* present on the ammonia water-mixture received from the collector chamber is skimmed off the mixture by means of the bucket wheel 2 and passed through the channel 3 under force of gravity into the comminution and homogenizing device. This device may consist of a mill or power mixer or any of the usual homogenizing devices. A preferred device would be a turbo-mixer. The float tar is subjected in that device to vigorous pressure and gravity so that the enclosed gas bubbles are displaced and the solids formed into a homogeneous high density mass. Thus, the dreaded floatation properties of the float tar are completely destroyed. The homogenized tar emanating from the comminuting and homogenizing device will have the properties of ordinary crude tar and can therefore now be combined with the bulk of the crude tar discharged through tube 8** for further processing. Alternatively it may also be subjected to separate processing.

EXAMPLE

During the coking of 5 tons coal per day with a water contents of 1% by weight of water, an amount of 200 tons tar accumulated in the gas collector of the installation together with the expelled gases including ammonia gas. This tar consisted of about 175 tons ordinary crude tar of high density and 25 tons of float tar. Fresh rinse water and recirculated ammonia water was then passed into the collector, the fresh water also forming ammonia water with the ammonia gas present in the collector chamber. Ammonia water and tar were then moved into the tar separator through which they flowed to be separated and discharged through different outlet tubes. In the tar separator the float tar was skimmed off by a bucket wheel having a total diameter of 1000 mm and was passed into the channel 3 which in this case had a width of 800 mm. The float tar then flowed down the inclined channel into a turbo-mixer. In the mixer a high gravity liquid tar was formed in a continuous operation which could readily be combined with the bulk of the crude tar.

The removal of the crude tar from the tar separator was effected in conventional manner by a scrape conveyor.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process for the separation of so-called float tar occurring in a tar separator where float tar, crude tar and ammonia-water layers are formed in the mass received for separation from the collector chamber of a coking installation, the said process comprising the steps of skimming the float tar consisting of a mixture of tar, coal dust, water and gas bubbles off the ammonia-water mixture flowing above the crude tar and passing the skimmed float tar to a comminuting and homogenizing zone and homogenizing and comminuting the float tar therein so as to convert it into a high viscosity tar which is then further processed either separately or together with the bulk of the crude tar.

2. The process of claim 1 wherein the float tar after separation is passed by gravity drop to the area where it is to be subjected to said comminution and homogenization.

3. The process of claim 1 wherein any residual flow tar remaining after said skimming action is removed by passing the ammonia water through a dam by which the residual float tar is removed from the flow of ammonia water.

4. An installation for the separation of float tar occurring in the tar separator of a coking plant where an ammonia water-crude tar mixture is received from a collector chamber of the coking plant, said installation comprising an open-top tar separator for receiving and separating said float tar and said ammonia-water mixture from said crude tar;

a channel in said tank separator normally floatingly supported on said ammonia-water mixture and extending across said tank separator;

skimming means in the form of a bucket wheel revolving in said tank separator for skimming the float tar from the ammonia-water mixture flowing in the tank separator and for passing the separated float tar into said channel; and a comminution and homogenizing means provided at one end of said channel for receiving and processing said float tar, whereby a high viscosity tar is formed from said float tar by the comminution and homogenizing means which is then passed for further processing separately or together with the bulk of the crude tar.

5. The installation of claim 4 wherein said channel extends at an incline from said tank separator to said comminution and homogenizing means, whereby the separated float tar is gravity fed to said communication and homogenizing means.

6. The installation of claim 4 wherein a dam is provided downstream of said bucket wheel and channel said dam extending across the tar separator in order to remove any residual float tar.

* * * * *

UNITED STATES PATENT AND TRADEMARK OFFICE

CERTIFICATE OF CORRECTION

PATENT NO. : 4,086,144

DATED : April 25, 1978

INVENTOR(S) : Heinz Grulich and Ernst Otte

It is certified that error appears in the above-identified patent and that said Letters Patent are hereby corrected as shown below:

In the heading, the names and addresses of the assignees should read:

Bergwerksverband GmbH, Essen, Germany and

Didier Engineering GmbH, Essen, Germany

Signed and Sealed this

*Fourth* Day of *December 1979*

[SEAL]

*Attest:*

SIDNEY A. DIAMOND

*Attesting Officer* *Commissioner of Patents and Trademarks*